US006953301B2

(12) United States Patent
Koga et al.

(10) Patent No.: US 6,953,301 B2
(45) Date of Patent: Oct. 11, 2005

(54) LID ASSEMBLY FOR FACILITY ACCESS OPENING

(75) Inventors: Kenichi Koga, Fukuoka (JP); Yukinori Gondou, Fukuoka (JP); Kazumi Tanaka, Fukuoka (JP); Masakazu Hidaka, Fukuoka (JP)

(73) Assignee: Hinode, Ltd., Fukuoka (JP)

( * ) Notice: Subject to any disclaimer, the term of this patent is extended or adjusted under 35 U.S.C. 154(b) by 0 days.

(21) Appl. No.: 10/503,513

(22) PCT Filed: Feb. 13, 2003

(86) PCT No.: PCT/JP03/01476

§ 371 (c)(1),
(2), (4) Date: Aug. 4, 2004

(87) PCT Pub. No.: WO03/069076

PCT Pub. Date: Aug. 21, 2003

(65) Prior Publication Data

US 2005/0115157 A1 Jun. 2, 2005

(30) Foreign Application Priority Data

Feb. 14, 2002 (JP) ..... 2002-036969

(51) Int. Cl.[7] ..... E02D 29/14
(52) U.S. Cl. ..... 404/25; 49/40
(58) Field of Search ..... 404/25, 26; 49/40; 52/19, 20; 137/364

(56) References Cited

U.S. PATENT DOCUMENTS 149,246 A * 3/1874 Price et al. ..... 404/25
1,600,761 A * 9/1926 Haase ..... 220/284
2,190,532 A * 2/1940 Lukomski ..... 210/164
4,614,065 A * 9/1986 Papp ..... 52/20
5,052,851 A * 10/1991 Frishauf ..... 404/25

FOREIGN PATENT DOCUMENTS

| | | |
|---|---|---|
| JP | 40-4350 | 2/1940 |
| JP | 57-46459 | 10/1982 |
| JP | 57-58296 | 12/1982 |
| JP | 3047851 U | 2/1998 |
| JP | 3056877 U | 12/1998 |

* cited by examiner

*Primary Examiner*—Gary S. Hartmann
(74) *Attorney, Agent, or Firm*—Frishauf, Holtz, Goodman & Chick, P.C.

(57) ABSTRACT

A cover assembly includes a support frame (20) fixed to a utility access hole and a rounded cover (10) fitted into the support frame. The support frame is provided in its upper portion with an S-curved inner peripheral surface (20*b*) having a convex curved surface portion (21) and a concave curved surface portion (22) that continues to the convex curved surface portion and is formed thereabove. The cover has an S-curved peripheral surface (10*b*) that is substantially complementary in shape to the S-curved inner peripheral surface of the support frame. When the access hole is closed by the cover, the cover is smoothly fitted into the support frame due to a guide function of the S-curved inner peripheral surface of the support frame.

5 Claims, 5 Drawing Sheets

LID ASSEMBLY FOR FACILITY ACCESS OPENING

This application is a U.S. National Phase Application under 35 USC 371 of International Application PCT/JP03/001476 filed Feb. 13, 2003.

TECHNICAL FIELD

The present invention relates to a cover assembly for a utility access hole, and more specifically to a cover assembly in which cover-closing work can be smoothly made.

BACKGROUND ART

In road surfaces and at entrances to aboveground utilities, there are formed access holes for accessing the underground and aboveground utilities, such as water, sewerage, gas, electricity, and communication utilities. The access hole is openable and closable by means of a cover assembly. The cover assembly is composed of a support frame fixed to the access hole and a cover removably fitted into the central hole of the support frame. The support frame and the cover generally utilized are ones that have slopes. The support frame with a slope has a central hole whose top portion is formed into an inverted cone (inverted trapezoid in vertical section) with a diameter decreasing downward in the vertical direction of the support frame, whereas the cover with a slope is formed into an inverted cone that is complementary to the top portion of the central hole of the support frame. In the cover assembly shown in FIG. 6, the support frame 20 is provided in its inner periphery with a shoulder 25 that is surmounted by the cover 10. As described in Examined Japanese Utility Model Publication Nos. 57-58296 and 57-46459, the cover and the support frame may be coupled to each other with a hinge or chain.

In case that a manhole opening as an access hole is opened, the worker slightly lifts the cover 10 from the support frame 20 with the aid of a crowbar and pulls out the cover 10 onto the road surface by the side of the manhole. In case that the manhole is closed, the cover 10 on the road surface is pushed diagonally downward into the central hole of the support frame 20 to be seated in the support frame. When being pushed into the support frame, however, the cover occasionally tilts greatly in the support frame. If the cover is further pushed in the support frame while being greatly inclined as mentioned, the edge of the cover 10 is brought into contact with the inner peripheral surface 26 of the support frame 20 as illustrated in FIGS. 5 and 6, so that the cover cannot be set in the support frame. If this happens, the worker has to pull out the cover from the support frame and redo the cover-closing work. Since the cover is heavy in general, the redo of the cover-closing work requires energy and time.

DISCLOSURE OF THE INVENTION

An object of the present invention consists in providing a cover assembly for a utility access hole, in which cover-closing work for fitting a cover into a support frame can be performed without difficulty.

To accomplish the above object, a cover assembly according to the invention comprises a support frame fixed to a utility access hole and having a circumferential wall that defines a central hole, at least an upper part of which has a round shape in plan, and a rounded cover that is removably fitted into the upper part of the central hole of the support frame to close the utility access hole. The circumferential wall of the support frame has an S-curved inner peripheral surface (hereinafter referred to as "S-shaped inner peripheral surface" on occasion) in an upper part thereof, and the S-curved inner peripheral surface includes a convex curved surface portion that is curved convexly with respect to the central hole of the support frame and a concave curved surface portion that continues to the convex curved surface portion and is formed above the convex curved surface portion and curved concavely with respect to the central hole of the support frame. The cover has an S-curved peripheral surface (hereinafter referred to as "S-shaped peripheral surface" on occasion) that is substantially complementary in shape to the S-curved inner peripheral surface of the circumferential wall of the support frame. The S-curved peripheral surface of the cover includes a concave curved surface portion that is substantially complementary in shape to the convex curved surface portion of the S-curved inner peripheral surface of the support frame and a convex curved surface portion that continues to the concave curved surface portion and is formed above the concave curved surface portion to have a substantially complementary shape to the concave curved surface portion of the S-curved inner peripheral surface of the support frame.

According to the present invention, the peripheral surface of the cover and the inner peripheral surface of the circumferential wall of the support frame are each formed into an S-curved surface having width in a radial direction, so that a rim of the cover can be securely seated on the inner peripheral surface of the circumferential wall of the support frame. Consequently, if in a state where the cover is almost set in the support frame, the worker pushes a rear rim of the cover with his/her foot to push the cover into the support frame or sets the cover into the support frame using a crowbar, a front rim of the cover gradually rises, while the rear rim thereof slowly enters the central hole of the support frame. In so doing, the rise of a front portion of the cover and the entry of a rear portion of the cover are easily carried out due to a guide function of the S-shaped inner peripheral surface of the circumferential wall of the support frame. Thus, the convex and concave curved surface portions of the S-shaped peripheral surface of the cover are interfitted with the concave and convex curved surface portions of the S-shaped inner peripheral surface of the support frame, respectively, whereby the utility access hole is closed by the cover. Simply by thus pushing the cover into the support frame, the cover can be smoothly set in the support frame.

Preferably, the circumferential wall of the support frame has an upper side-sloped inner peripheral surface that continues to the S-curved inner peripheral surface and is formed above the S-curved inner peripheral surface. The upper side-sloped inner peripheral surface is formed into an inverted cone with a diameter increasing toward an upper part thereof. The cover has an upper side-sloped peripheral surface that continues to the S-curved peripheral surface and is formed above the S-curved peripheral surface. The upper side-sloped peripheral surface is formed into an inverted cone that is complementary to the upper side-sloped inner peripheral surface of the circumferential wall of the support frame.

More preferably, the circumferential wall of the support frame has a lower side-sloped inner peripheral surface that continues to the S-curved inner peripheral surface and is formed below the S-curved inner peripheral surface to have a shape of an inverted cone with a diameter increasing toward an upper part thereof. The cover also has a lower side-sloped peripheral surface that continues to the S-curved peripheral surface and is formed below the S-curved peripheral surface to have a shape of an inverted cone that is complementary to the lower side-sloped inner peripheral surface of the circumferential wall of the support frame.

According to the above-described preferred embodiment, when the cover is installed in the support frame, the upper side-sloped peripheral surface of the cover is brought into contact with the upper side-sloped inner peripheral surface of the support frame (preferably the upper side- and lower side-sloped peripheral surfaces of the cover touch the upper side- and lower side-sloped inner peripheral surfaces of the support frame, respectively). Such a structure for slopes makes it possible to securely support the cover by the support frame and then to prevent the cover from jouncing with respect to the support frame, thereby avoiding infiltration of earth and sand, rainwater, and the like from the outside into the utility access hole.

It is more preferable that the cover and the circumferential wall of the support frame be so formed that the S-curved peripheral surface of the cover does not touch the S-curved inner peripheral surface of the support frame when the upper side-sloped peripheral surface of the cover is brought into contact with the upper side-sloped peripheral surface of the support frame (preferably when the upper side- and lower side-sloped peripheral surfaces of the cover touch the upper side- and lower side-sloped peripheral surfaces of the support frame, respectively).

According to the preferred embodiment, when the cover is installed in the support frame, the upper side-sloped peripheral surface (preferably the upper side- and lower side-sloped peripheral surfaces) of the cover is brought into contact with the upper side-sloped inner peripheral surface (preferably the upper side- and lower side-sloped inner peripheral surfaces) of the support frame over the whole circumference, whereas the S-shaped peripheral surface of the cover and the S-shaped inner peripheral surface of the support frame do not touch each other. This prevents overbite of the cover, and at the same time surely averts the jounce motion of the cover and the infiltration of earth and sand, rainwater, and the like.

BEST MODE OF CARRYING OUT THE INVENTION

A cover assembly according to one embodiment of the present invention will be described below with reference to FIGS. 1 through 4.

The cover assembly of the embodiment comprises a rounded cover 10 and a support frame 20 for supporting the cover, and is fixed to a utility access hole, for example a manhole opening 30*b*, such that an upper surface 10*a* of the cover 10 is on substantially the same level as a ground level 30*a* (FIG. 3). Although not shown in FIG. 3, there is settled in the ground a pit pedestal or the like that is surmounted by a flange portion 20*d* of the support frame 20.

Figure 1:
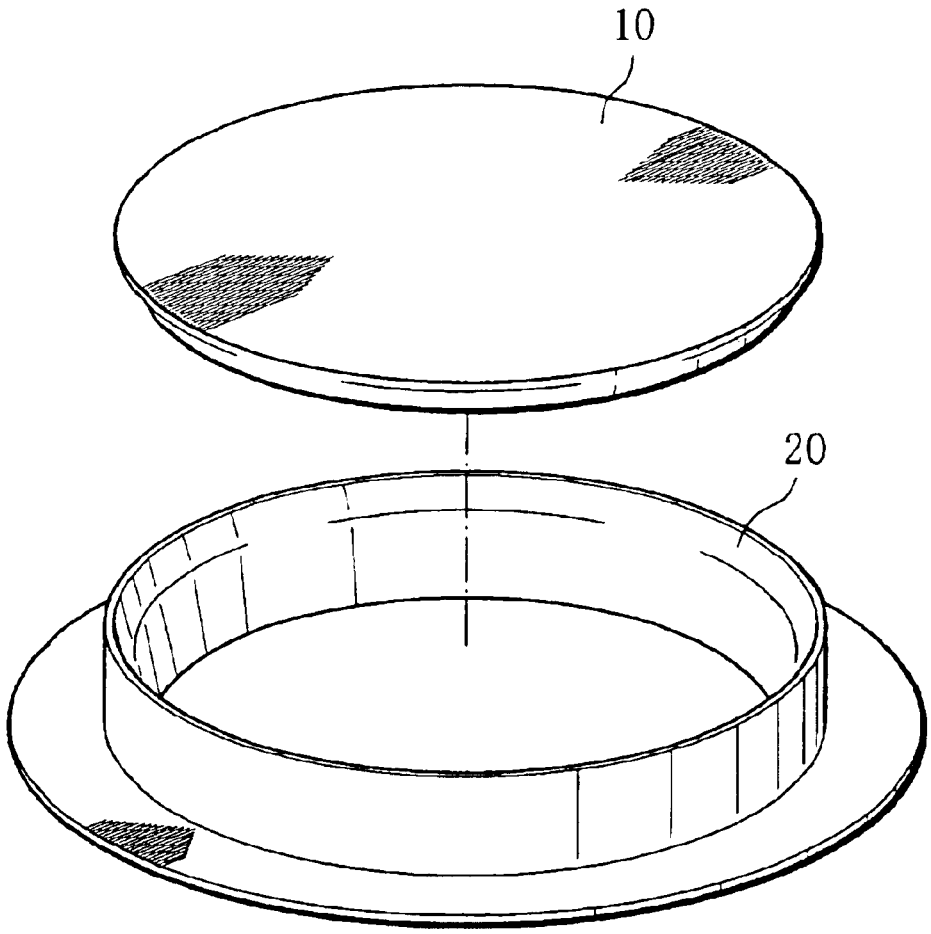
FIG. 1 is an exploded perspective view of a cover assembly according to one embodiment of the present invention.
Figure 2:
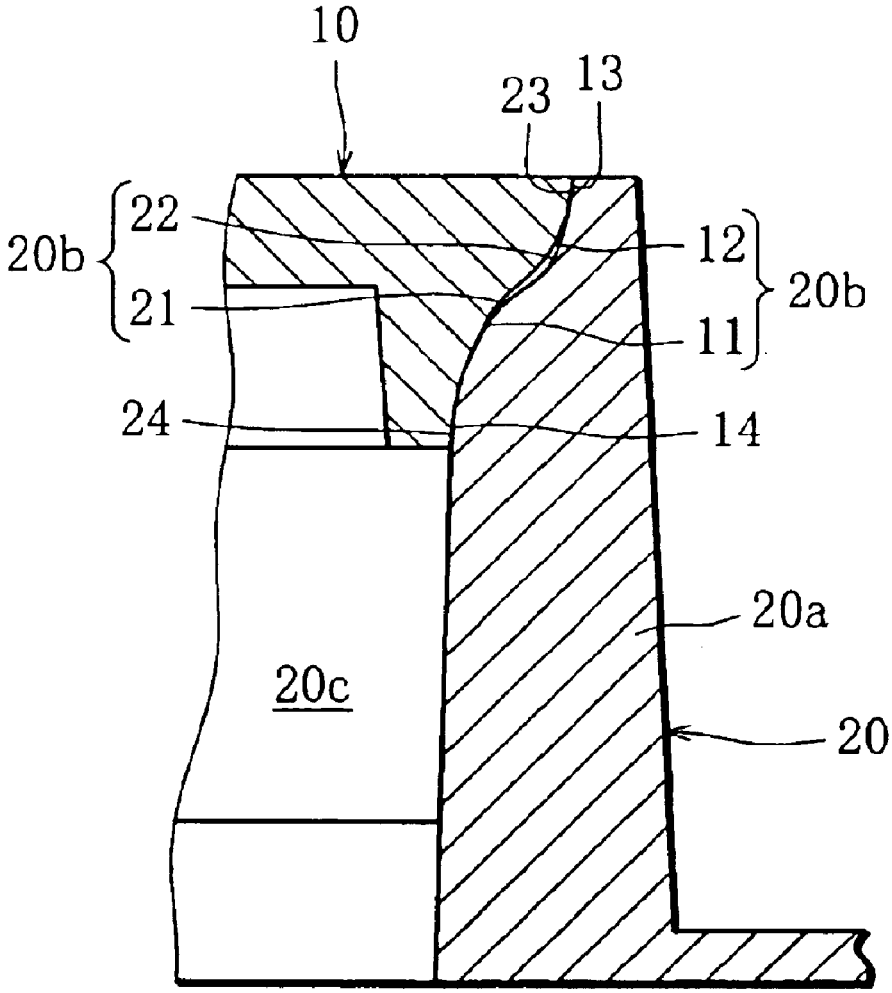
FIG. 2 is a partial enlarged longitudinal section of the cover assembly in a closed state where a cover is supported by a support frame.

As illustrated in FIG. 2, the support frame 20 has a circumferential wall 20*a* that defines a central hole 20*c* having a round shape in plan. The cover 10 is removably fitted in a top portion of the central hole 20*c* to close the manhole opening 30*b*. In addition, the cover 10 may be coupled to the support frame 20 with a hinge or chain, not shown.

The circumferential wall 20*a* of the support frame has an S-curved inner peripheral surface (hereinafter referred to as S-shaped inner peripheral surface) 20*b* in a top portion thereof. The S-shaped inner peripheral surface 20*b* includes a convex curved surface portion 21 and a concave curved surface portion 22 that smoothly continues to the convex curved surface portion 21 and is formed above the convex curved surface portion 21. The convex curved surface portion 21 of the S-shaped inner peripheral surface 20*b* is curved convexly with respect to the central hole 20*c*, and the concave curved surface portion 22 is curved concavely with respect to the central hole 20*c*.

The circumferential wall 20*a* of the support frame has an upper side-sloped inner peripheral surface 23 that continues to the concave curved surface portion 22 of the S-shaped inner peripheral surface 20*b* and is formed above the concave curved surface portion 22, and a lower side-sloped inner peripheral surface 24 that continues to the convex curved surface portion 21 of the S-shaped inner peripheral surface 20*b* and is formed below the convex curved surface portion 21. The upper side- and lower side-sloped inner peripheral surfaces 23, 24 are each formed into an inverted truncated cone (inverted trapezoid in vertical section) with a diameter increasing toward an upper part thereof, and thus extend obliquely with respect to a central axis of the circumferential wall 20*a* of the support frame (central axis of the cover assembly) in vertical section.

The cover 10 has an S-curved peripheral surface (hereinafter referred to as S-shaped peripheral surface) 10*b* that is substantially complementary to the S-shaped inner peripheral surface 20*b* of the circumferential wall 20*a* of the support frame. The S-shaped peripheral surface 10*b* includes a concave curved surface portion 11 that is curved concavely with respect to the support frame 20 and a convex curved surface portion 12 that smoothly continues to the concave curved surface portion 11 and is formed above the concave curved surface portion 11 and curved convexly with respect to the support frame 20. The concave curved surface portion 11 and the convex curved surface portion 12 of the S-shaped peripheral portion 10*b* of the cover 10 are formed substantially complementary in shape to the convex curved surface portion 21 and the concave curved surface portion 22 of the S-shaped inner peripheral surface 20*b* of the support frame 20, respectively.

Furthermore, the cover 10 has upper side- and lower side-sloped peripheral surfaces 13, 14 each having a shape of an inverted truncated cone, which are substantially complementary to the upper side- and lower side-sloped inner peripheral surfaces 23, 24 of the circumferential wall 20*a* of the support frame, respectively. The upper side-sloped peripheral surface 13 of the cover 10 continues to the S-shaped peripheral surface 10*b* of the cover 10 and is formed above the S-shaped peripheral surface 10*b*. The lower side-sloped peripheral surface 14 continues to the S-shaped peripheral surface 10*b* and is formed below the S-shaped peripheral surface 10*b*.

The upper side- and lower side-sloped peripheral surfaces 13, 14 of the cover 10 extend obliquely in vertical section with respect to the central axis of the cover assembly at the same angle as a slope angle of the upper side- and lower side-sloped inner peripheral surfaces 23, 24 of the circumferential wall 20*a* of the support frame. In vertical section, length of the upper side-sloped peripheral surface 13 of the cover 10 is shorter than the upper side-sloped inner peripheral surface 23 of the circumferential wall 20*a* of the support frame. Consequently, when the cover 10 is installed in the support frame 20, the upper side- and lower side-sloped peripheral surfaces 13, 14 of the cover 10 are interfitted with the upper side- and lower side-sloped inner peripheral surfaces 23, 24 of the circumferential wall 20*a* of the support frame, respectively, while the S-shaped peripheral surface 10*b* of the cover 10 does not touch the S-shaped inner peripheral surface 20*b* of the circumferential wall 20*a* of the support frame. The achievement of such a structure for slopes makes it possible to discourage overbite and jounce motion of the cover 10 with respect to the support frame 20 and infiltration of earth and sand, rainwater and the like.

Figure 7:
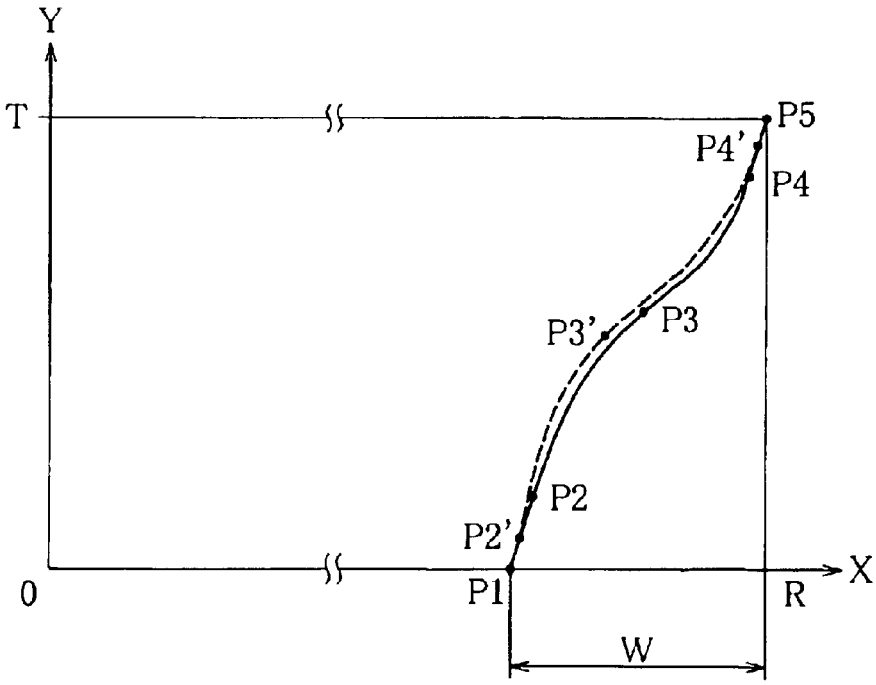
FIG. 7 is a view for explaining a shape of the peripheral surface of the cover and that of the inner peripheral surface of the circumferential wall of the support frame.

With reference to FIG. 7, a shape of the peripheral surface of the cover 10 and that of the inner peripheral surface of an upper portion of the circumferential wall 20*a* will be further described below.

In an X–Y coordinate system shown in FIG. 7, X and Y coordinates correspond to an opening bottom surface of the cover 10 and the central axis of the cover assembly, respectively. In FIG. 7, T denotes thickness of the cover 10, R denotes a radius of the cover 10, and W denotes thickness of the upper portion of the circumferential wall 20*a*.

In FIG. 7, a first compound curved line shown by a solid line is composed of a first straight line P1P2, a first curved line P2P3, a second curved line P3P4, and a second straight line P4P5. A solid of revolution, which can be obtained by rotating the first compound curved line around a Y-axis, has a peripheral surface corresponding to an inner peripheral surface of a top portion of the circumferential wall 20*a* of the support frame. A second compound curved line shown by a broken line is composed of a third straight line P1P2', a third curved line P2'P3', a fourth curved line P3'P4', and a fourth straight line P4'P5. A peripheral surface of a solid of revolution of the second compound curved line corresponds to the peripheral surface of the cover 10.

The cover assembly of the embodiment is achieved as a structure for slopes, in which the cover 10 is interfitted with and supported by the upper side- and lower side-sloped inner peripheral surfaces 23, 24 of the support frame 20 while the S-shaped peripheral surface 10*b* of the cover 10 and the S-shaped inner peripheral surface 20*b* of the support frame 20 do not touch each other. In this connection, the second straight line P4P5 corresponding to the upper side-sloped inner peripheral surface 23 of the support frame 20 is made longer than the fourth straight line P4'P5 corresponding to the upper side-sloped peripheral surface 13 of the cover 10.

Moreover, the peripheral surface 10*b* of the cover and the inner peripheral surface 20*b* of the circumferential wall 20*a* of the support frame are each formed into an S-curved surface. As a result, the cover can be moved without a hitch due to a guide function of the support frame while being in line contact with the support frame during cover-closing work. Accordingly, the first and second curved lines P2P3 and P3P4 and the third and fourth curved lines P2'P3' and P3'P4' are made into S-shaped curved lines corresponding to the S-shaped inner peripheral surface 20*b* and the S-shaped peripheral surface 10*b*, respectively.

Figure 3A:
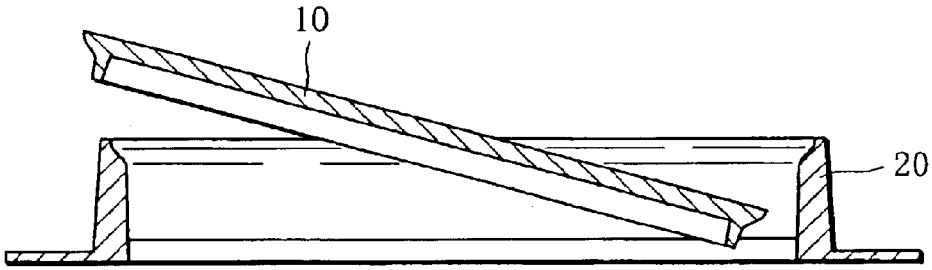
FIG. 3A is a cross-section showing the cover assembly in the process of setting the cover in the support frame for completing cover-closing work.
Figure 3B:
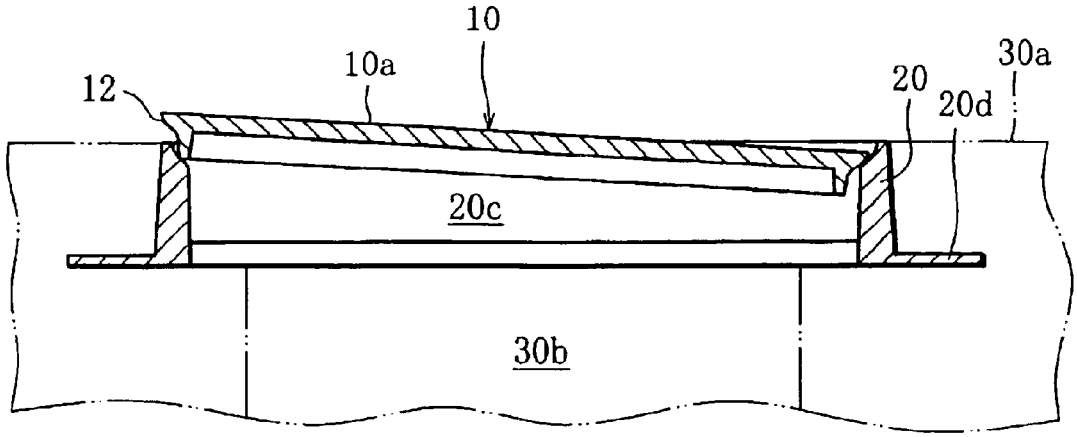
FIG. 3B is a cross-section showing the cover assembly in which the cover is further set in the support frame.
Figure 4:
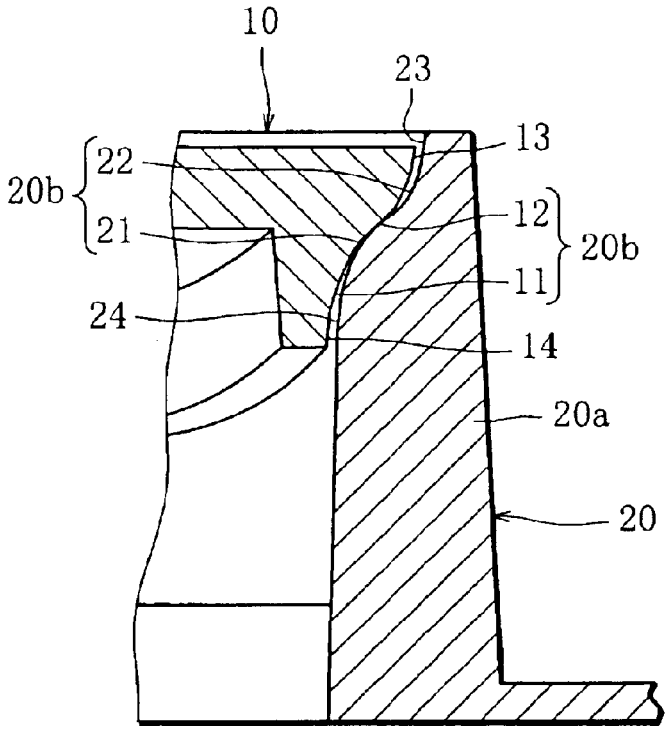
FIG. 4 is a partial enlarged cross-section showing the cover assembly in which a peripheral surface of the cover and an inner peripheral surface of a circumferential wall of the support frame are brought into contact with each other.
Figure 5:
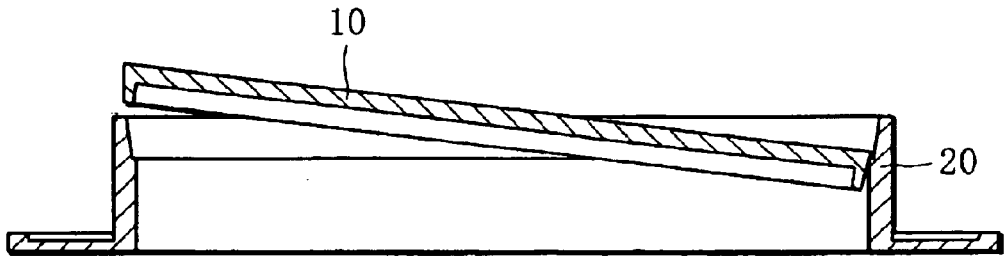
FIG. 5 is a view for explaining a cover-closing operation in a conventional cover assembly.

With reference to FIGS. 3 and 4, a cover-closing operation of the cover assembly will be explained below.

At the time of closing a manhole opening 30*b* by the cover 10, in the process of setting the cover 10 in the support frame 20 as shown in FIG. 3A, a front portion (right side in the drawing) of the cover 10 slightly falls in the support frame 20. However, the convex curved surface portion 12 located near a middle portion of the cover 10 is supported by the convex curved surface portion 21 of the support frame 20, and a rear portion (left side in the drawing) is located outside the support frame 20.

Subsequently, the worker thrusts a rear rim of the cover 10 with his/her foot to push the cover into the support frame 20 or pulls the cover into the support frame with the aid of a crowbar. Thus, as illustrated in FIG. 3B, a front rim of the cover gradually rises along the S-shaped inner peripheral surface 20*b* of the support frame, and the rear rim of the cover slowly enters the central hole 20*c* of the support frame. At this moment, due to the guide function of the S-shaped inner peripheral surface 20*b* of the circumferential wall of the support frame, the front portion of the cover readily rises in the support frame, and simultaneously the rear portion of the cover enters the support frame without any trouble, thereby closing the manhole opening 30*b* by the cover. Merely by pushing the cover into the support frame in this manner, the cover can be easily seated in the support frame.

When the cover 10 is installed in the support frame 20, the upper side- and lower side-sloped peripheral surfaces 13, 14 of the cover 10 are brought into contact with the upper side- and lower side-sloped inner peripheral surfaces 23, 24 of the support frame 20 over the whole circumference, respectively, while the S-shaped peripheral surface 10*b* of the cover 10 and the S-shaped inner peripheral surface 20*b* of the support frame 20 do not touch each other. This prevents the overbite and jounce motion of the cover 10 with respect to the support frame 20 and the infiltration of earth and sand, rainwater and the like into the manhole opening 30*b*.

The present invention is not limited to the above-described embodiment and may be modified in various ways.

The above description of the embodiment refers to the case in which the invention is applied to the cover assembly that opens/closes the manhole opening. The invention, however, is applicable to various kinds of cover assemblies. For instance, the invention can be applied to a manhole cover, a large-sized iron cover, and a soil chamber cover to be fixed to the access holes for accessing underground buried objects, underground structure facilities and the like for sewerage. The invention is also applicable to openable/closable iron covers for a multipurpose underground conduit, power transmission and distribution, which are utilized to protect underground facility devices, underground cables and the like for electric power and communications. The invention is further applicable to a fire hydrant cover, a gate valve cover, a slice valve cover, an air valve cover, a cover for gas piping, and a water meter cover serving as opening/closing doors for accessing to buried conduit pipes for water supply and gas piping and ancillary equipment therefor. The invention is not limited to the cover assembly for an access hole for accessing underground utility and may be applied to one for opening/closing the access hole provided to an entrance to aboveground utility.

Figure 6:
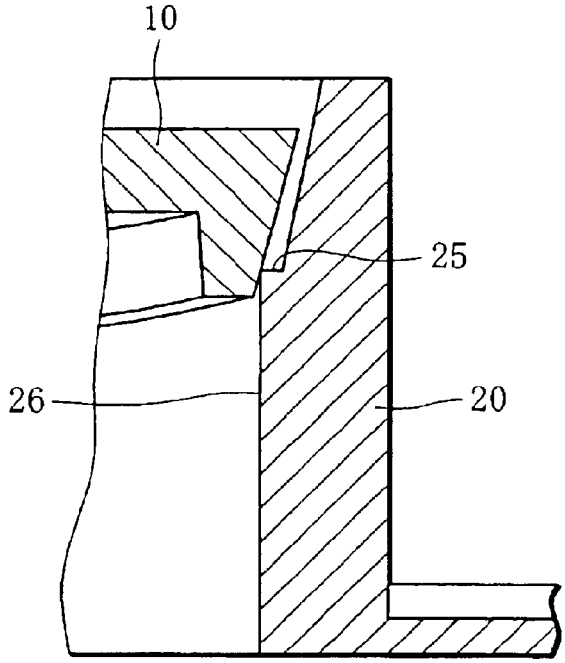
FIG. 6 is a partial enlarged cross-section of the cover assembly of FIG. 5.

Furthermore, according to the above-described embodiment, the cover is provided with the upper side- and lower side-sloped peripheral surfaces, and the circumferential wall of the support frame with the upper side- and lower side-sloped inner peripheral surfaces. It is possible, however, to provide the cover only with the upper side-sloped peripheral surface, and to provide the circumferential wall of the support frame with the upper side-sloped inner peripheral surface. Alternatively, the cover may be provided only with the S-shaped peripheral surface instead of the upper side- and lower side-sloped peripheral surfaces, and additionally the circumferential wall of the support frame may be provided only with the S-shaped inner peripheral surface. Furthermore, the shoulder denoted by reference numeral 25 in FIG. 6 may be disposed in the circumferential wall of the support frame. In this case, the shoulder is formed below the lower side-sloped inner peripheral surface of the circumferential wall of the support frame so as to continue to the lower side-sloped inner peripheral surface. In case that the circumferential wall of the support frame has no lower side-sloped inner peripheral surface, the shoulder may be formed below the S-shaped inner peripheral surface of the circumferential wall of the support frame so as to continue thereto.

Likewise in the other respects, various modifications of the invention can be made without deviating from the gist thereof.

What is claimed is:

1. A cover assembly for a utility access hole comprising a support frame fixed to the utility access hole and having a circumferential wall that defines a central hole, at least an upper portion of which has a round shape in plan, and a rounded cover that is removably fitted into the upper portion of the central hole of the support frame to close the utility access hole, wherein:

the circumferential wall of said support frame has an S-curved inner peripheral surface in an upper portion thereof, said S-curved inner peripheral surface having a convex curved surface portion that is curved convexly with respect to the central hole of said support frame and a concave curved surface portion that continues to said convex curved surface portion and is formed above said convex curved surface portion and curved concavely with respect to the central hole of said support frame; and said cover has an S-curved peripheral surface that is substantially complementary in shape to the S-curved inner peripheral surface of the circumferential wall of said support frame, said S-curved peripheral surface having a concave curved surface portion that is substantially complementary in shape to the convex curved surface portion of the S-curved inner peripheral surface of said support frame and a convex curved surface portion that continues to said concave curved surface portion and is formed above said concave curved surface portion to have a substantially complementary shape to the concave curved surface portion of the S-curved inner peripheral surface of said support frame.

2. The cover assembly according to claim 1, wherein:

the circumferential wall of said support frame has an upper side-sloped inner peripheral surface that continues to the S-curved inner peripheral surface thereof and is formed above said S-curved inner peripheral surface to have a shape of an inverted cone with a diameter increasing toward an upper part thereof; and said cover has an upper side-sloped peripheral surface that continues to the S-curved peripheral surface thereof and is formed above said S-curved peripheral surface to have a shape of an inverted cone that is complementary to the upper side-sloped inner peripheral surface of the circumferential wall of said support frame.

3. The cover assembly according to claim 2, wherein said cover and the circumferential wall of said support frame are so formed that when the upper side-sloped peripheral surface of said cover is brought into contact with the upper side-sloped inner peripheral surface of said support frame, the S-curved peripheral surface of said cover does not touch the S-curved inner peripheral surface of said support frame.

4. The cover assembly according to claim 2, wherein:

the circumferential wall of said support frame has a lower side-sloped inner peripheral surface that continues to the S-curved inner peripheral surface thereof and is formed below said S-curved inner peripheral surface to have a shape of an inverted cone with a diameter increasing toward an upper part thereof; and said cover has a lower side-sloped peripheral surface that continues to the S-curved peripheral surface and is formed below said S-curved peripheral surface to have a shape of an inverted cone that is complementary to the lower side-sloped inner peripheral surface of the circumferential wall of said support frame.

5. The cover assembly according to claim 4, wherein said cover and the circumferential wall of said support frame are so formed that when the upper side- and lower side-sloped peripheral surfaces of said cover are brought into contact with the upper side- and lower side-sloped peripheral surfaces of said support frame, respectively, the S-curved peripheral surface of said cover does not touch the S-curved inner peripheral surface of said support frame.

* * * * *